US007611408B2

(12) United States Patent
Martin et al.

(10) Patent No.: US 7,611,408 B2
(45) Date of Patent: Nov. 3, 2009

(54) SYSTEM FOR COMMUNICATING WITH A PLAYER THROUGH A MOUNTABLE INTERACTIVE INTERFACE

(75) Inventors: Kim Martin, Las Vegas, NV (US); Scott A. Boyd, Las Vegas, NV (US)

(73) Assignee: IGT, Reno, NV (US)

( * ) Notice: Subject to any disclaimer, the term of this patent is extended or adjusted under 35 U.S.C. 154(b) by 879 days.

(21) Appl. No.: 10/888,562

(22) Filed: Jul. 8, 2004

(65) Prior Publication Data

US 2006/0009291 A1 Jan. 12, 2006

(51) Int. Cl.
*A63F 9/24* (2006.01)

(52) U.S. Cl. ..... 463/29; 463/42

(58) Field of Classification Search ..... 463/42–43, 463/29

See application file for complete search history.

(56) References Cited

U.S. PATENT DOCUMENTS 5,265,874 A * 11/1993 Dickinson et al. ..... 463/25
5,429,361 A * 7/1995 Raven et al. ..... 463/25
5,537,290 A 7/1996 Brown et al.
5,655,961 A 8/1997 Acres et al.
5,870,027 A 2/1999 Ho
6,050,487 A * 4/2000 Bonifas et al. ..... 235/375
6,222,507 B1 * 4/2001 Gouko ..... 345/1
6,319,125 B1 * 11/2001 Acres ..... 463/25
6,371,852 B1 4/2002 Acres
6,375,567 B1 4/2002 Acres
6,375,569 B1 4/2002 Acres
6,587,082 B1 * 7/2003 Moore ..... 345/1.3
6,646,695 B1 11/2003 Gauselmann
6,712,698 B2 * 3/2004 Paulsen et al. ..... 463/30
6,896,618 B2 * 5/2005 Benoy et al. ..... 463/25
7,112,138 B2 * 9/2006 Hedrick et al. ..... 463/29
2001/0039212 A1 11/2001 Sawano et al.
2001/0044337 A1 11/2001 Rowe
2003/0054868 A1 * 3/2003 Paulsen et al. ..... 463/1
2003/0054881 A1 * 3/2003 Hedrick et al. ..... 463/29
2004/0082380 A1 * 4/2004 George et al. ..... 463/25

FOREIGN PATENT DOCUMENTS

EP 0 534 718 A2 3/1993
EP 0 935 986 A3 8/1999
GB 2 394 186 A 4/2004
WO WO 01/99067 A3 12/2001
WO WO 03/008060 A1 1/2003
WO WO 03/027970 A3 4/2004

OTHER PUBLICATIONS

U.S. Appl. No. 09/694,065, filed Oct. 19, 2000, John F. Acres.

(Continued)

*Primary Examiner*—Peter DungBa Vo
*Assistant Examiner*—Masud Ahmed
(74) *Attorney, Agent, or Firm*—Weaver Austin Villeneuve & Sampson LLP.

(57) ABSTRACT

The present invention relates to a system for communicating with a player of a networked gaming device using a mountable interactive player interface incorporating a touch screen display to enable cashless gaming, player tracking, bonus, and secondary game features.

10 Claims, 14 Drawing Sheets

OTHER PUBLICATIONS

U.S. Appl. No. 60/282,703, filed Apr. 9, 2001, Kevan L. Wilkins.
U.S. Appl. No. 10/120,196, filed Apr. 9, 2002, Kevan L. Wilkins.
British Examination Report dated Nov. 6, 2007, from corresponding British Application No. GB0500299.3.
British Search Report dated Feb. 25, 2005, from corresponding British Application No. GB0500299.3.
International Search Report and Written Opinion Of The International Searching Authority dated Sep. 28, 2005, from corresponding PCT Application No. PCT/US2005/023732.
International Preliminary Report on Patentability dated Jan. 18, 2007, from corresponding PCT Application No. PCT/US2005/023732.

* cited by examiner

SYSTEM FOR COMMUNICATING WITH A PLAYER THROUGH A MOUNTABLE INTERACTIVE INTERFACE

TECHNICAL FIELD

The present invention relates to a player interface associated with an electronic gaming device and, more particularly, to mounting such an interface on or near a gaming device, where such an interface includes a display and an input device to provide interactive communication with the player.

BACKGROUND

Incorporating casino slot machines into a computer network is known. Early in the deployment of such networks, preexisting slot machines were retrofitted by installing a communications board that included a processor, memory and other components that facilitated communications between the electronic slot machine and the network. When so configured, transactions at one of slot machines could be communicated via the board onto the network and from there to a computer that stored the transactions for later analysis and verification. Conversely, the network computer can issue commands onto the network that are addressed to a particular machine or a group of machines. The communications board receives the command and communicates with the slot machine to effect, for example, payment of a bonus over and above the pay table in the slot machine as described in U.S. Pat. No. 5,655,961, which is owned by the assignee of the present application and which is incorporated herein by reference for all purposes.

In addition to the communications board, it is also known to install a card reader, a display, and a keypad at each slot machine to facilitate player tracking, as it is referred to in the industry. In a conventional player-tracking system, each player is assigned a card and an associated account, which is maintained on a network computer. Before playing one of the slot machines, the player inserts his or her card to cause points proportionate to play to accrue in his or her account. The points are then redeemable by the player for additional play, dinners, merchandise, or the like. In addition, the card, keypad and display, which is typically a vacuum fluorescent display or a small-character LCD display, can be used to permit a player to access a cashless play account or to access credits that are either complimentary or awarded to the player during the course of his or her play.

The design, construction and operation of networked slot machines, including the card reader, the keypad and the display, as mentioned above, is described in detail in the '961 patent. Another embodiment is also described in U.S. Pat. No. 6,319,125 for a Method and Apparatus for Promoting Play on a Network of Gaming Devices, which is also assigned to the assignee of the present application and which is also incorporated herein by reference for all purposes.

In addition to player-tracking functions, cashless play and associated functions can be implemented using the system of FIG. 1 as described in U.S. patent application Ser. No. 09/694,065, which is assigned to the assignee of the present application and which is incorporated herein by reference for all purposes. In addition, conversion of player-tracking points into playable credit can also be implemented using the system of FIG. 1 as described in U.S. Pat. No. 6,371,852, which is also assigned to the assignee of the present application and which is also incorporated herein by reference for all purposes.

SUMMARY

In one aspect, the invention features a mounting structure associated with a plurality of networked gaming devices. The mounting structure comprises a plurality of receivers coupled to the mounting structure and a first display constructed and arranged to be mounted on one of the plurality of receivers.

In another aspect, the invention features a method for retrofitting a plurality of networked gaming devices with player displays. The method comprises associating a mounting structure with one or more of the plurality of networked gaming devices, coupling a first display with one of a plurality of receivers on the mounting structure, and configuring at least one of the plurality of networked gaming devices to communicate with the first display.

DETAILED DESCRIPTION

Figure 1:
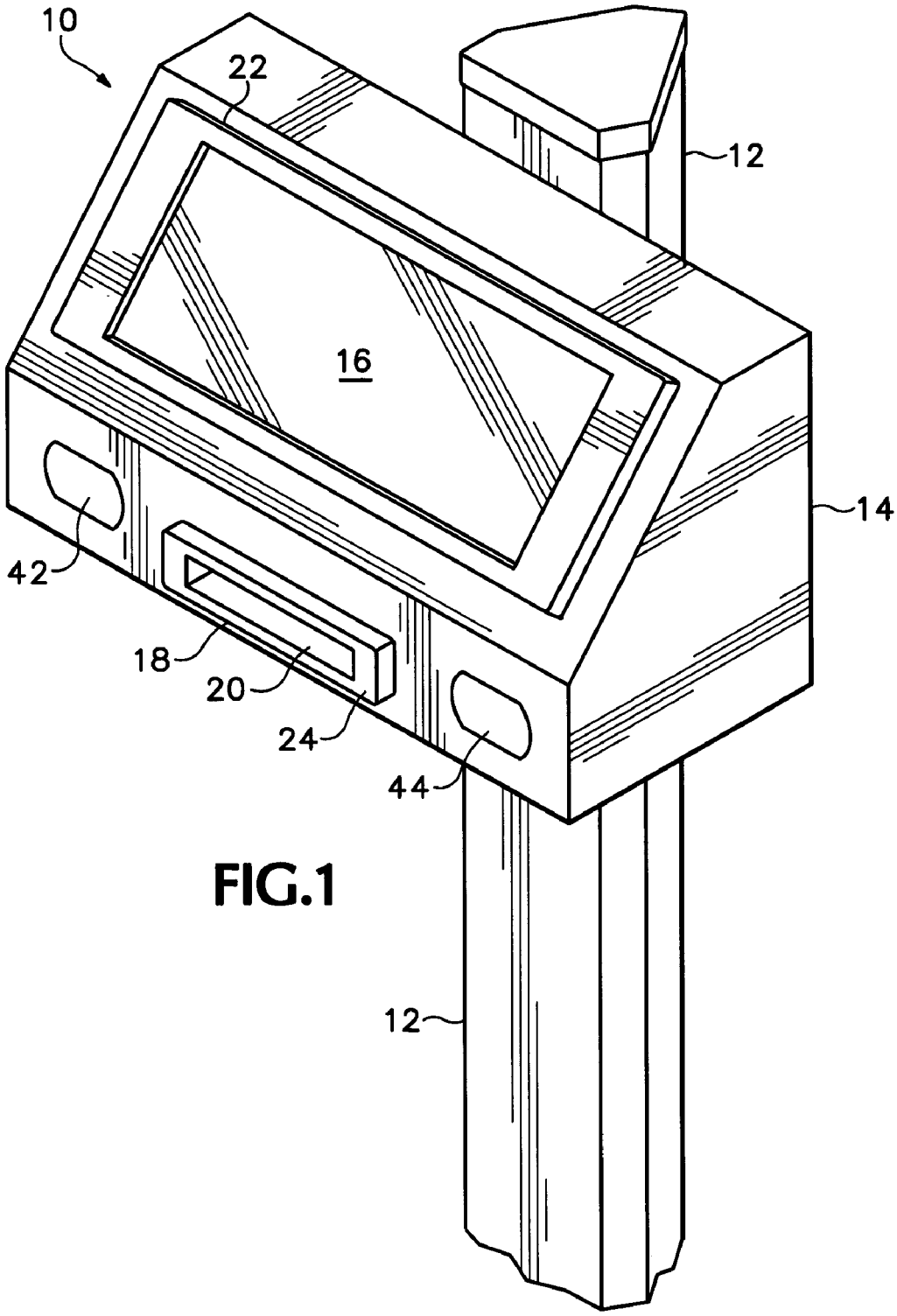
FIG. 1 is a partial isometric view of a player interface that is part of an implementation of the present embodiment of the invention.
Figure 2:
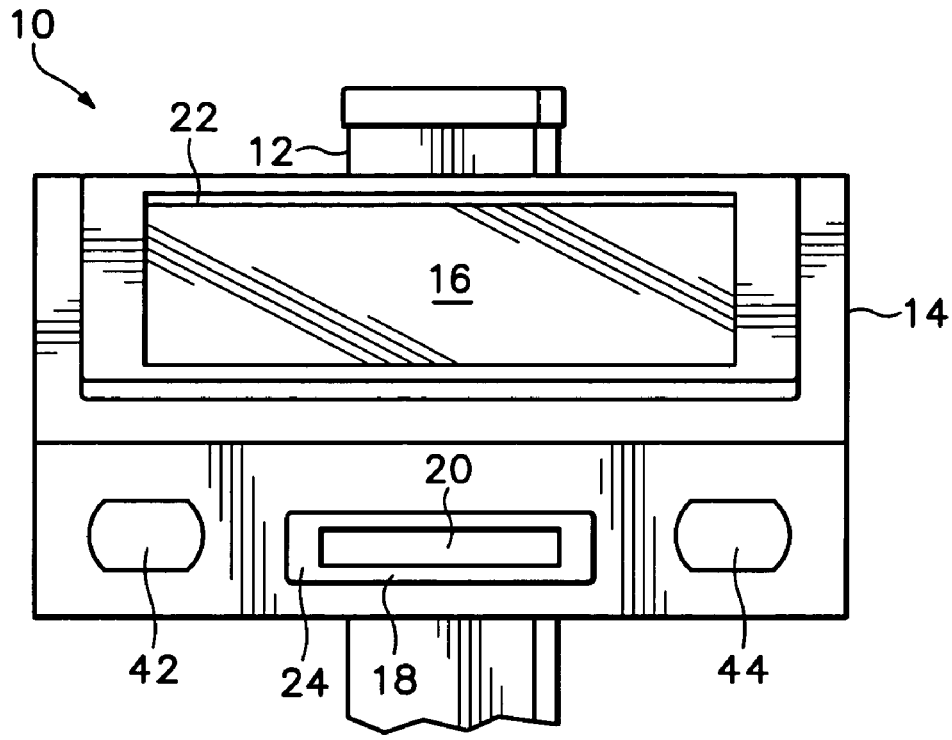
FIG. 2 is a front view of the partial view of the player interface of FIG. 1.
Figure 3:
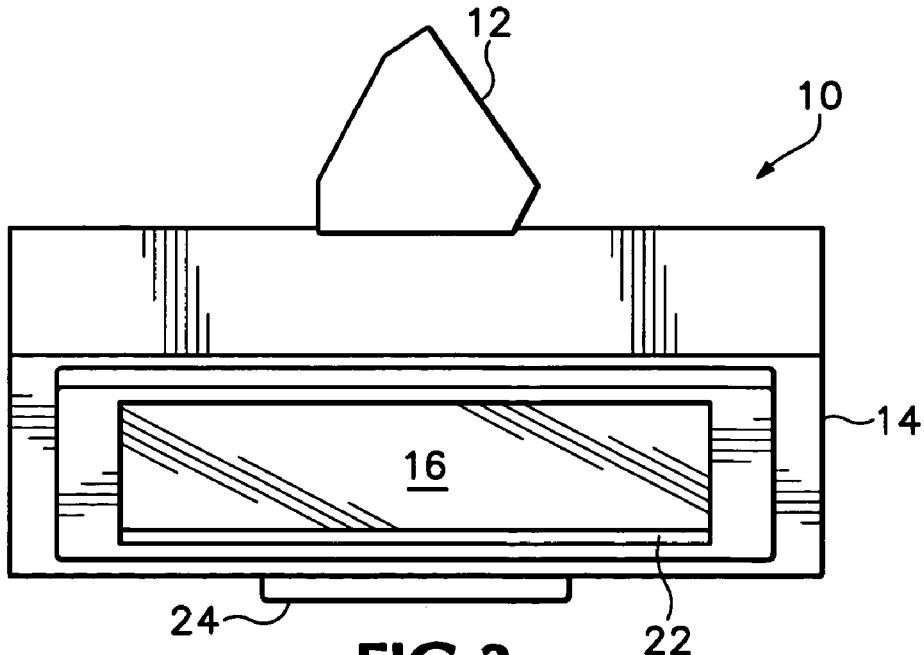
FIG. 3 is a top view of the display of FIG. 2.

Turning first to FIGS. 1-6, indicated generally at 10 is an interactive player interface or display that can be mounted to a slot machine or mounted on a pole, post, column or pillar 12 located either near or away from the slot machine. Each interface 10 can be associated with one or more slot machines or gaming devices. The mounting of such interfaces 10 can be permanent, where the interface is fused or otherwise secured to the pole or column 12, or temporary, where the interface 10 is snapped, strapped, bolted, fixed, or otherwise attached to the pole or column.

The interactive player interface 10 includes a housing 14 that can be mounted on the front or side of a slot machine (not shown) or can be mounted on a pole, post, column or pillar 12 located near or away from a slot machine. It is preferable that the interfaces 10 be located in close proximity to the gaming devices but the interfaces can be located anywhere as long as they can be in communication with the casino's computer network (discussed with respect to FIGS. 7 and 8). Such networking can be wire-based or use wireless communication. Additionally, hollow poles or columns can be used to allow for networking and storage of wires and cables associated with the interface 10.

Figure 4:
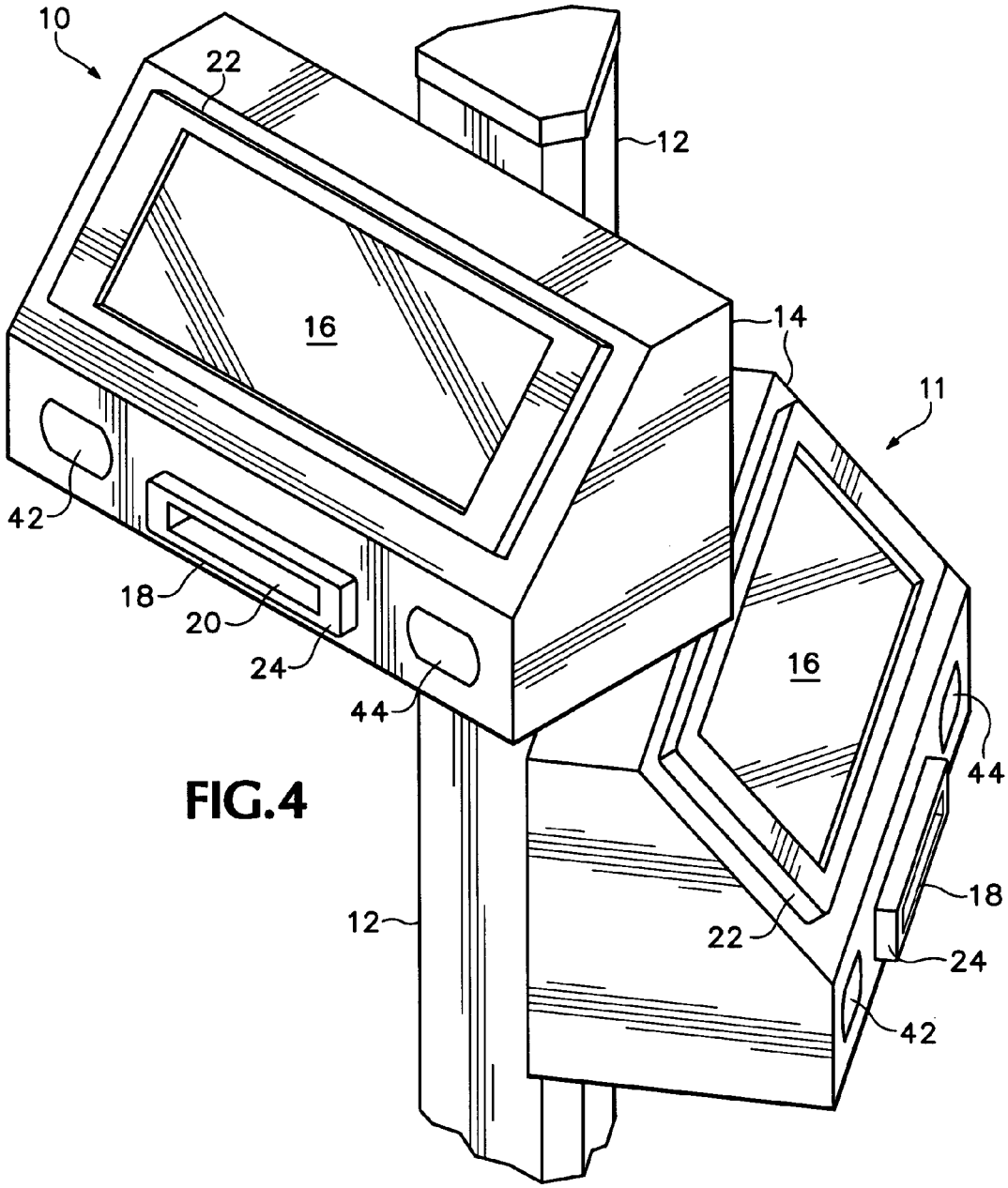
FIG. 4 is a partial isometric view of a plurality of column-mounted player interfaces that are part of an implementation of a second embodiment of the present invention.
Figure 5:
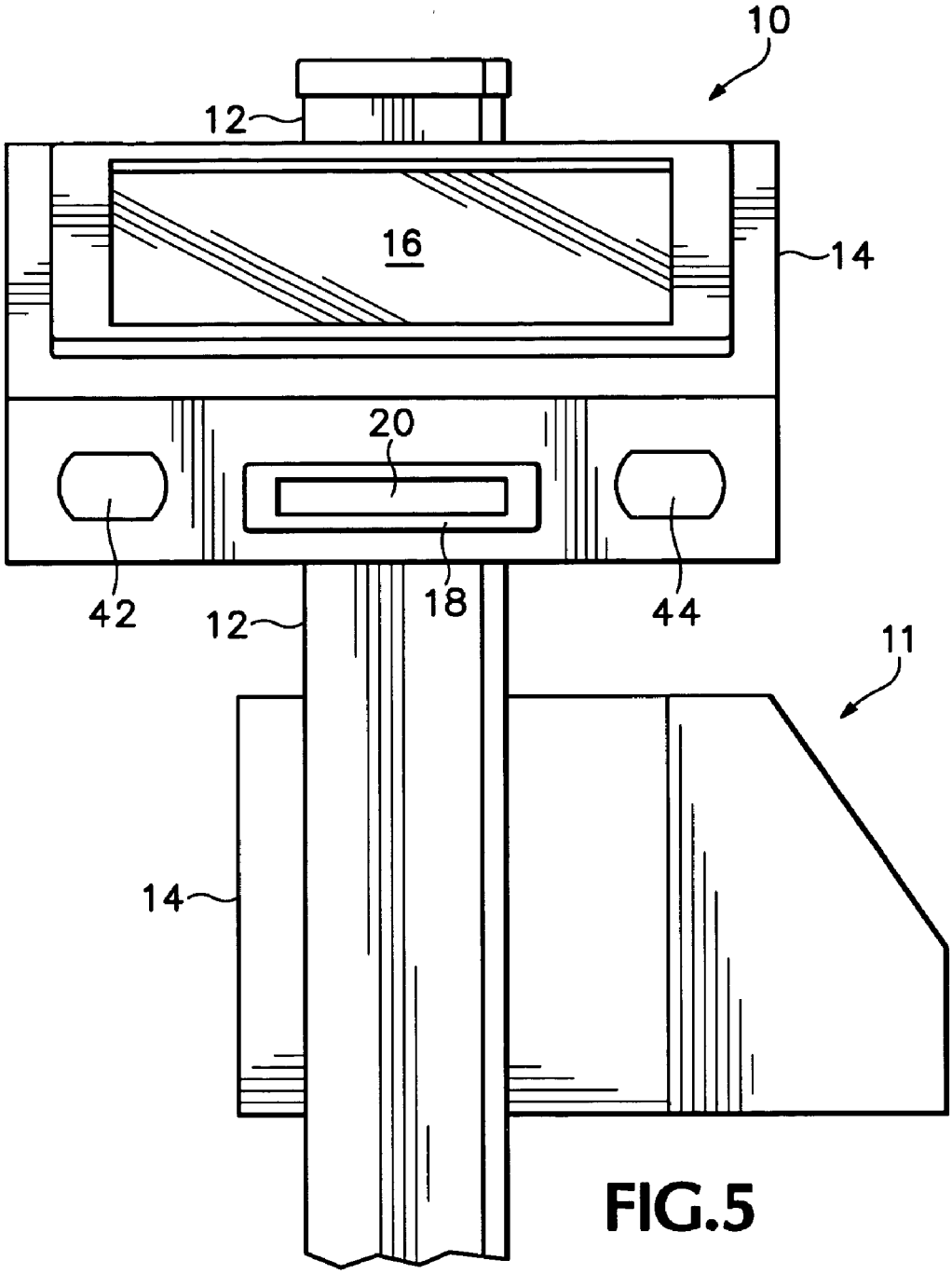
FIG. 5 is front view of the partial view of the player interface of FIG. 4.
Figure 6:
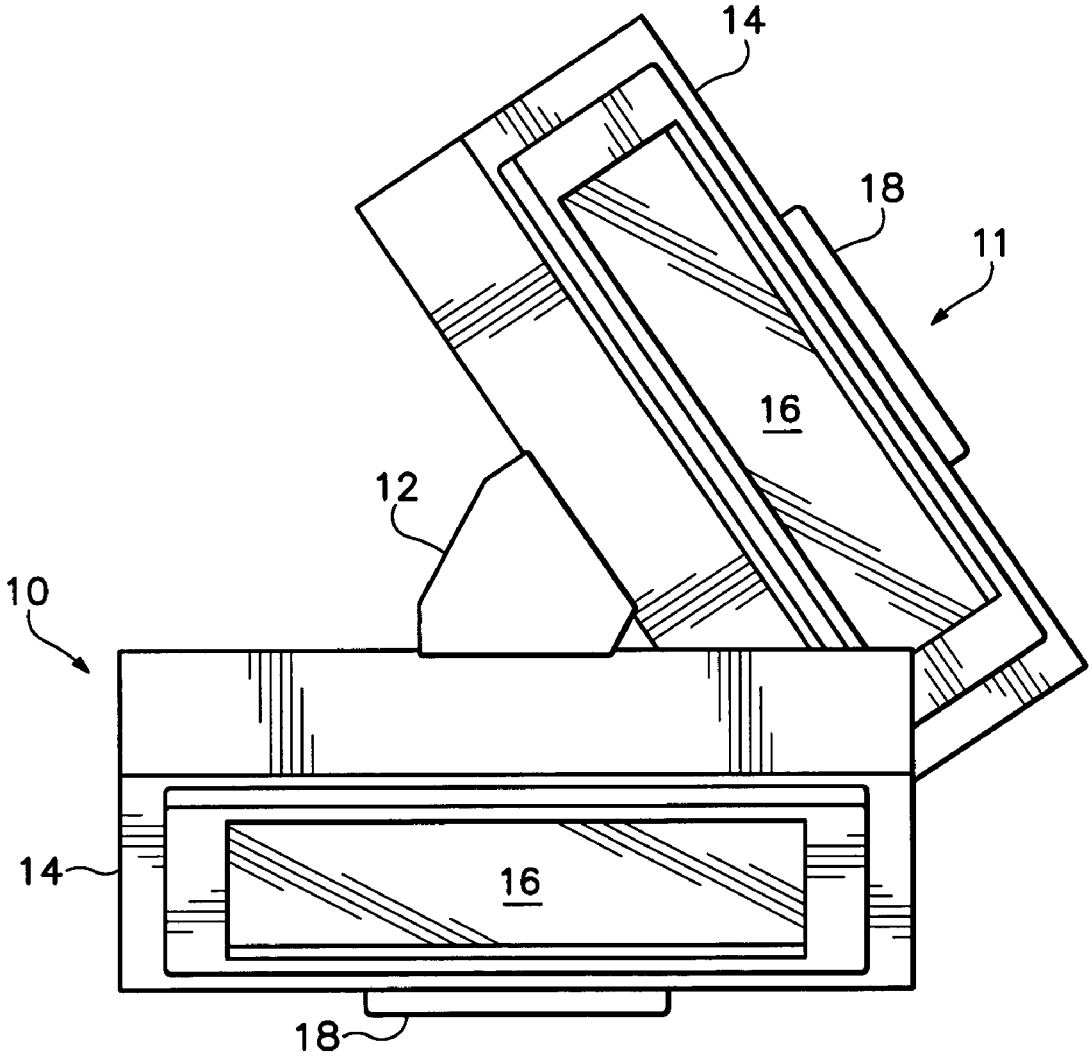
FIG. 6 is top view of the display of FIG. 5.

As shown in FIGS. 4-6, multiple interactive player interfaces 10, 11 can be mounted to a single column in installations where space is at a premium. The player interfaces 10, 11 shown in FIGS. 4-6 are mounted on different facets of a column to provide simultaneous access to the interfaces by players at different gaming devices. The column or pole 12 need not have facets for mounting purposes, as a cylindrical pole can likewise be used for mounting. The interfaces or displays can be interchangeably or removably mounted to the columns 12 using brackets, harnesses, or quick remove connections, collectively receivers, that enable the interfaces to be easily removed or replaced, while offering security to the casino and the casino's equipment and computer network. To allow for the individual player's comfort, the brackets or quick remove connections can be structured so as to permit the interfaces to be rotatable about the column or pole 12, and can likewise be structured to pivot in an upward, downward, or sideways motion to account for glare or other adverse lighting conditions in a given casino. To facilitate the interchangeability of the interfaces, the columns 12 can be selectively perforated with knock-out covers to allow for the mounting of interfaces 10, 11 at various heights, angles, and spacing. The columns 12 can likewise be perforated in such a manner to permit the bracket to be slideably positioned within the perforation to adjust the height of the interface to suit the player.

In FIGS. 4-6 two interactive player interfaces 10, 11 are shown, however several player interfaces could be attached to a single column 12. In application, the number of player interfaces coupled to a single column 12 will likely be dictated by, for example, the size of the housing, the size of the display, the distance between the column and the gaming devices, the available floor space of the casino, the layout of the banks of gaming devices, aesthetics, etc.

As shown in FIGS. 4-5, the interfaces 10, 11 can be staggered or mounted at different heights to accommodate a greater number of such interfaces on a single pole or column and players using gaming devices staggered at different heights. While it is contemplated that groups of gaming devices will be laid out in banks with a single column 12 serving a bank, a column 12 or group of interfaces 10, 11 can be used by players playing gaming devices dispersed in any configuration, whether the gaming devices are set in rows, in a rectangular or square arrangement, or even in a round or polygonal arrangement.

The housing 14 includes four openings, the first containing a 640×240 touch-panel liquid crystal display ("LCD") 16. In the present embodiment of the invention, LCD 16 comprises a Hitachi SX16H005-AZA LCD. The second opening 18, in FIGS. 1 and 4, contains a card reader having a slot 20, into which a player's card is received as is known in the art. As shown in FIGS. 1 and 4, both LCD 16 and slot 20 are framed by respective bezels 22, 24.

Figure 7:
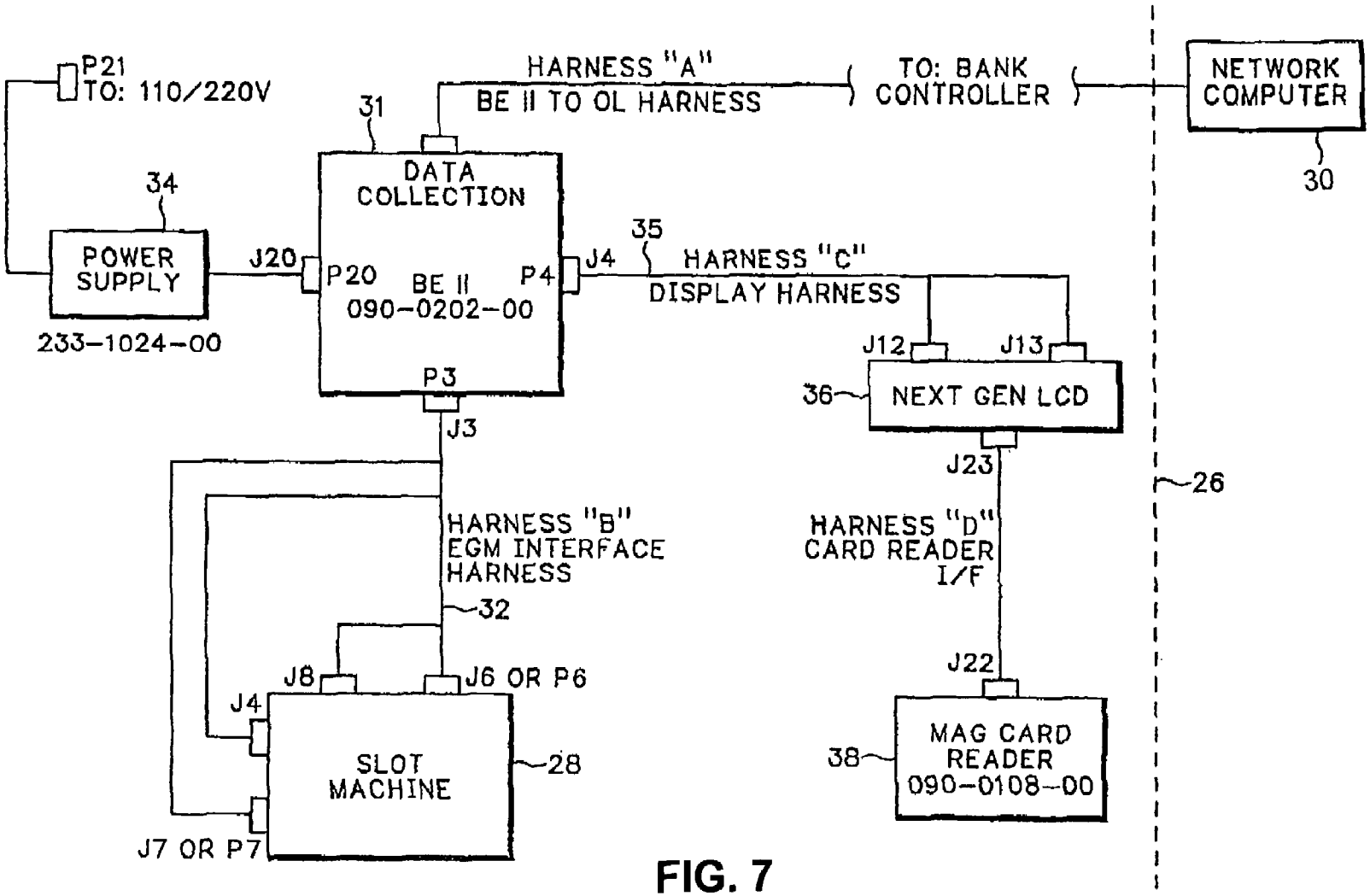
FIG. 7 is a block diagram of the slot machine display and card reader of FIGS. 1 and 4.

Turning now to FIG. 7, the schematic components depicted therein on the left side of dashed line 26 are all contained within the cabinet that houses the slot machine or are contained within the interactive player interface 10 in FIGS. 1 and 4. Slot machine electronics 28 are part of the original slot machine structure provided by the slot-machine manufacturer. The additional components on the left side of line 26, however, are all added to implement the invention in association with electronics and the network.

The components on the left side of line 26, are connected to a computer network, along with numerous additional slot machines having the related structure depicted in FIG. 7. The network is illustrated as a computer 30 on the right side of dashed line 26. Networked slot machines are known in the art and are depicted in the '961 and '125 patents. The network includes databases for storing slot machine transactions and player tracking data, servers for implementing system games and bonuses, configuration work stations for configuring the system games and bonuses, and a Content Manager, which is a program implemented on a network computer that permits an operator of the system, typically a casino, to customize and configure images that appear on display 16.

The slot-machine electronics 28 are connected to a system-machine interface board 31 via a wiring harness 32. Board 31 provides communications between the slot machine electronics 28 and network 30 in a manner that is described in the '961 and '125 patents. A power supply 34 provides power to board 31. A wiring harness 35 connects board 31 with the display and associated electronics 36. Another harness connects board 31 to the network including computer 30. The power supply also supplies power to electronics 36 and to a card reader 38. The card reader is behind bezel 24 in FIG. 1 and includes slot 20.

Figure 8:
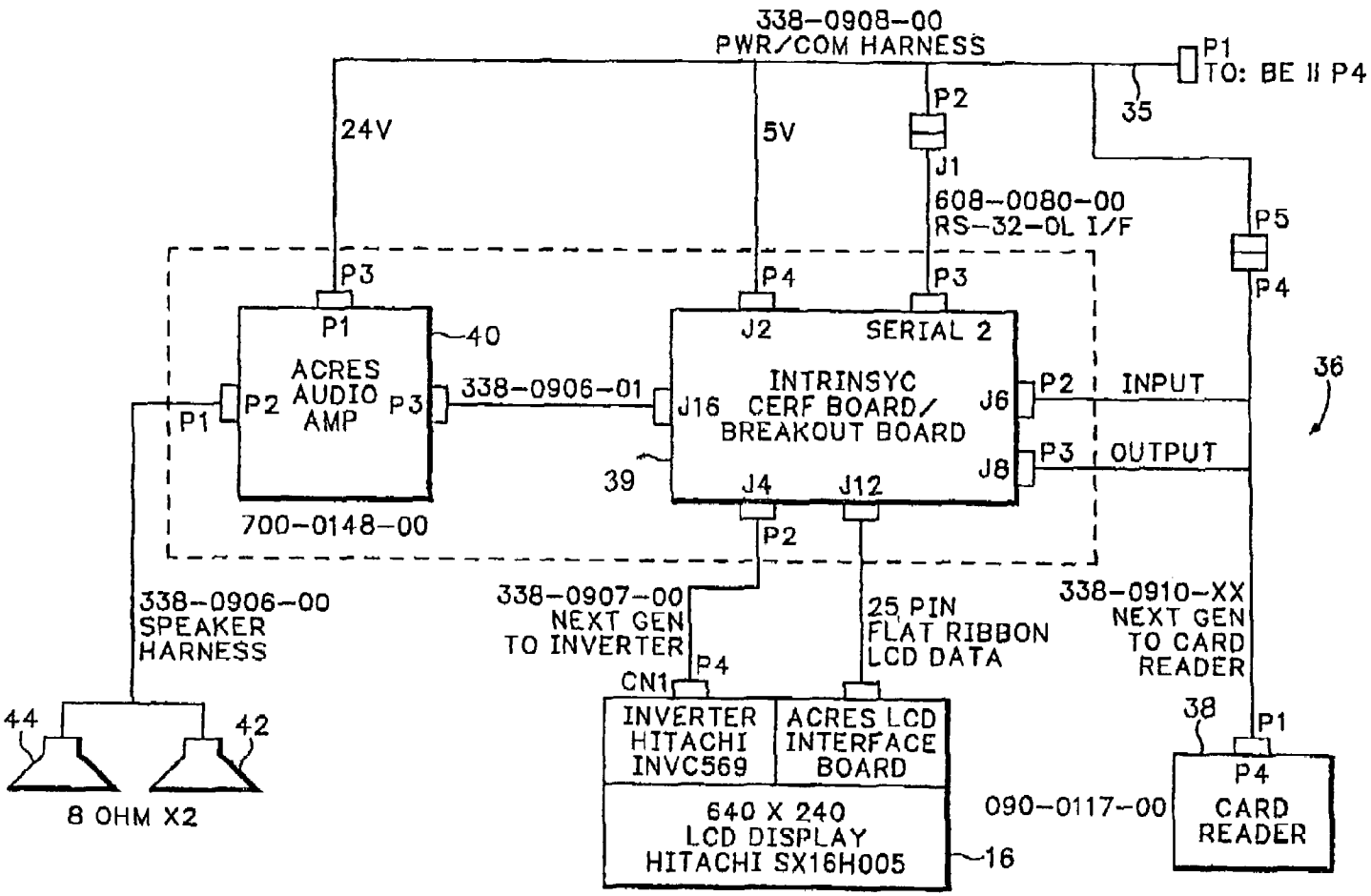
FIG. 8 is a block diagram of the displays and related components of FIGS. 1 and 4.

Turning now to FIG. 8, additional details of the display and associated electronics 36 in FIG. 7 are depicted schematically.

A dedicated computer 39 includes an LCD controller and electronics for enabling VGA touch panel images and sound for LCD 16. In the present embodiment of the invention, computer 39 is a commercially available processor board manufactured by Intrinsyc. It includes an Intel ARM processor and a Windows CE operating system. Computer 39 also includes nonvolatile memory for storing images and sounds that are utilized as described hereinafter. An amplifier 40 provides sound signals to speakers 42, 44, which are partially visible in FIG. 1.

In the present embodiment of the invention, the networked slot machines are initially configured using the Content Manager, which—in the present embodiment of the invention—runs on the same network PC platform as a configuration work station, which enables files to be downloaded to the system-machine interface board, like board 31, associated with each slot machine. Once the screens and features of individual screens are selected at the Content Manager, an initialization file is created that identifies which MMC files and features have been selected. The configuration workstation can then be used to download the initialization file and associated MMC files to all the machines, to groups of machines, or even to a single selected machine. These initialization files and associated MMC files are stored in nonvolatile memory in electronics 36. All parameters associated with the audio content and with display 16 can be configured in this manner.

In operation of the prior art VFD, System Tokens—such as a player's name or accrued points—are embedded in a slot-machine message comprising otherwise constant text strings that appear on the VFD. For example in the message Hello Richard, Hello comprises a constant text string and Richard comprises the System Token, here, the player name associated with the player card in use.

In the present invention, an MMC Token is embedded in the prior art VFD message, which may include System Tokens, that is transmitted to board 31 by the network and from there to board 39. As a result, if the message is received by a slot machine associated with a VFD, the usual VFD message is displayed. If it is received by a slot machine associated with an LCD display 16, the MMC message identified by the MMC Token is called from storage in electronics 39 and run, incorporating any System Tokens as specified in the network message. But when a VFD message that does not include an MMC Token is received at a machine associated with an LCD display, the FIG. 9 emulation screen appears bearing the VFD message in the upper half, and emulating a prior art keypad, which is associated with the VFD in prior art machines. This feature permits gradual introduction of LCD machines on a network and gradual introduction of MMC messages to any LCD machines that are on the network. Multimedia content can thus be downloaded on the gaming-machine network and displayed on the LCD as described above.

Figure 9:
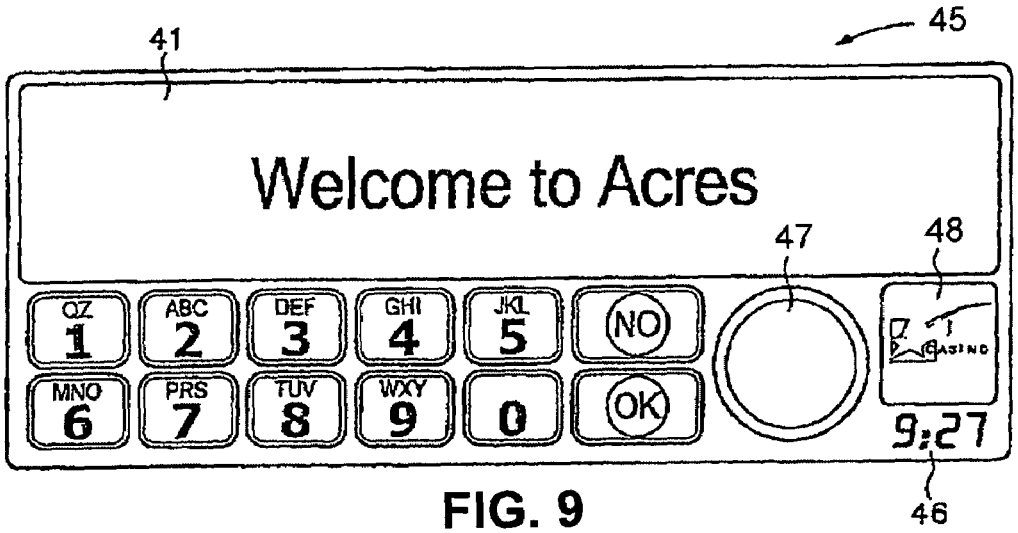
FIG. 9 is a view of an image that can be shown on the display and card reader on the slot machine of FIGS. 1 and 4.

In FIG. 9, display 16 is shown with an image that appears when the system emulates a prior art vacuum florescent display (VFD), like that disclosed in the '961 and '125 patents. The touch screen display image includes a keypad 45, a message screen 41, a bonus button 47, a casino logo 48, and a time display 46. Unless it is otherwise clear from the context, use of the term "button" herein refers to an image of a button on the touch screen, which enables a player to interact with the network by touching screen 16 over the button image. The casino operator has the option, implemented via the Content Manager, of displaying various features such as the bonus button and the system time, dependent upon the operator's preference. Emulation mode is advantageous in two situations. First, if the touch screen display has not been configured, or configured incorrectly, the image of FIG. 9 appears. Second, when prior art systems are retrofitted to include some slot machines that are associated with the touch screen LCD of the present invention and others that incorporate the prior art VFD, there may be some network display messages that are not implemented with the multimedia content ("MMC") used by LCD 16. If so, the system defaults to VFD emulation mode, in which VFD messages are displayed on message screen 41, while the player enters commands using the keypad and bonus button. In this mode, the touch keypad and the message panel 41 emulate the behavior of the prior art VFD and keypad, respectively.

In another embodiment of the invention, a separate network, i.e., a different network from the one computer 30 is on, is connected to board 39. This separate network provides MMC to board 39 for displaying images or playing audio. Such a network could be used to deliver real-time multimedia content to the display 16 and speakers 42, 44. In addition, this network is used to deliver real-time video, either broadcast or closed circuit, to the display while play is ongoing. The keypad image on the touch screen display is used by the player to select a broadcast or closed-circuit channel. This configuration could permit a player to watch, e.g., a sporting event or other show while gaming.

Figure 10:
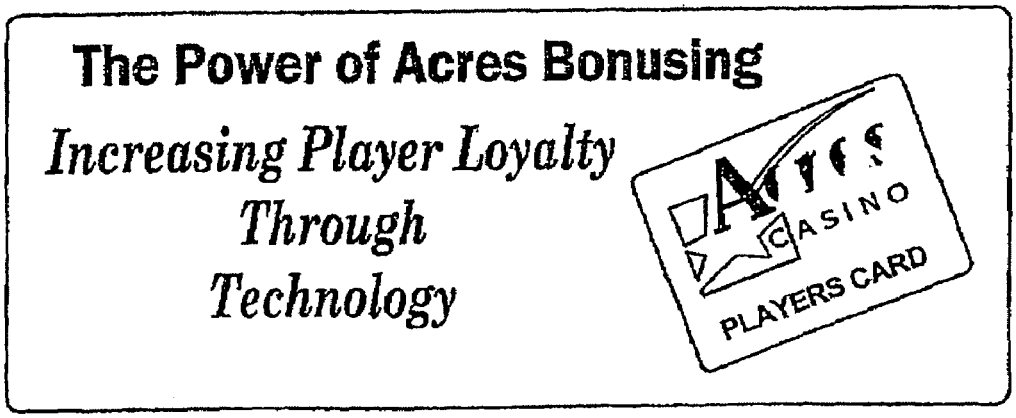
FIGS. 10-27 are views of images that can be shown on the display of FIGS. 1 and 4.

FIG. 10 depicts an example of display 16 in idle-attract mode, i.e., when there is no player card inserted in slot 20. When there is no card, the system displays up to 32 full size screens in a repeating sequence. Using a computer and keyboard on the network, the operator can control the duration, time of day, and sound associated with the idle-attract mode.

Figure 11:
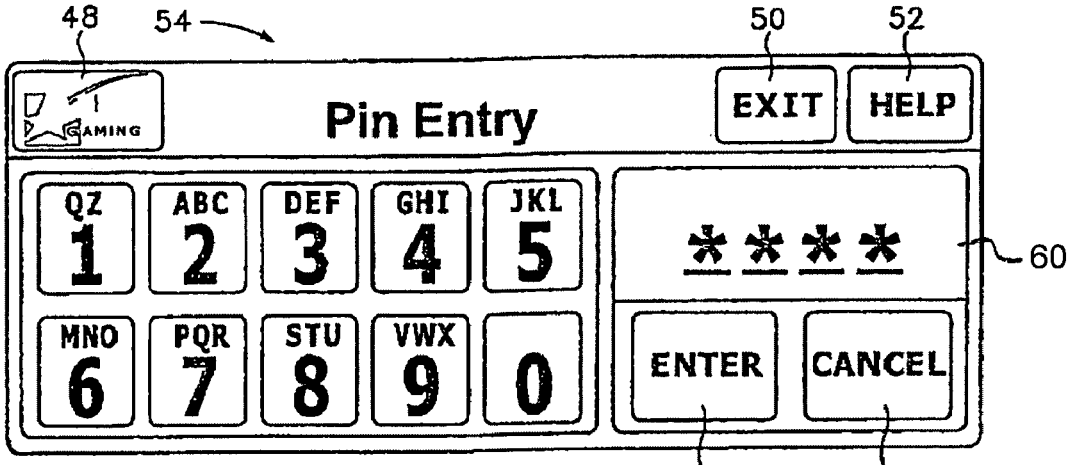
Figure 14:
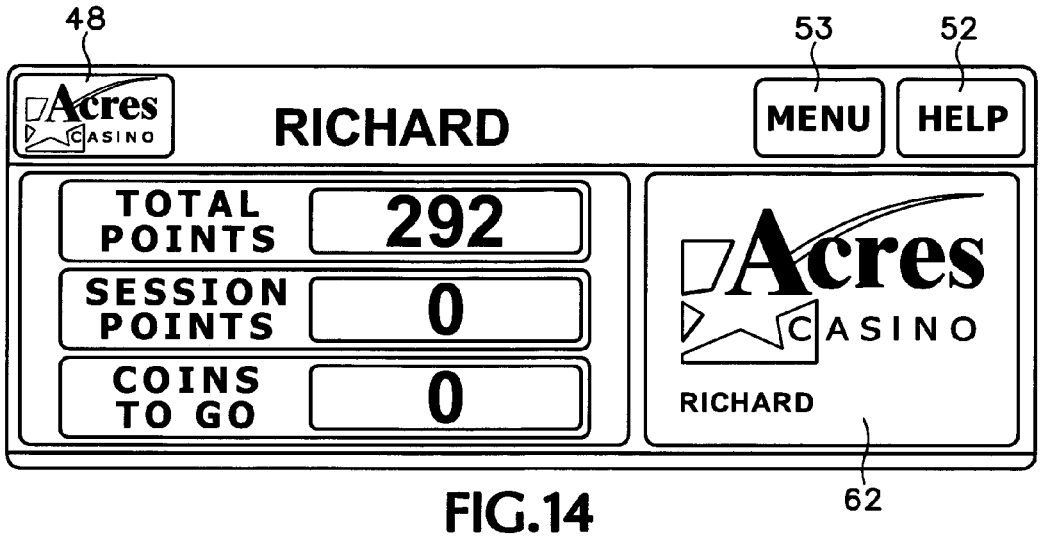

Turning to FIG. 11, the display is shown as it appears after a player enters his or her card into slot 20 of the card reader. This display includes a title, Pin Entry, PIN being an acronym for Personal Identification Number, a number that is stored on the network in association with the player's account. Also included is a casino logo 48, in the present embodiment of the invention, the logo of the assignee being utilized for illustrative purposes. In the upper right-hand corner of the display are an Exit button 50 and a Help button 52. Exit button 50 permits the player to cancel current operations or to move back to the previous screen. In FIG. 11, if Exit button 50 is pressed, the system resumes the idle-attract mode of FIG. 10. Pressing Help button 52 retrieves up to 8 screens of help information (e.g., as shown in FIG. 14) that can be configured on the Content Manager.

The display of FIG. 11 also includes a touch keypad 54, a touch Enter button 56, a touch Cancel button 58, and a PIN entry field 60, which displays an asterisk each time a digit from the player's PIN is entered on keypad 54.

In operation, when a player enters his or her card into slot 20, the FIG. 11 image appears on display 16. The player enters the PIN associated with the player card by pressing the digits on keypad 54 and hitting Enter button 56. The Content Manager can be used to change the number of PIN digits required. There is also an auto enter feature that can be implemented at the Content Manager that sends the PIN to board 31 without waiting for the player to push the Enter button.

Figure 12:
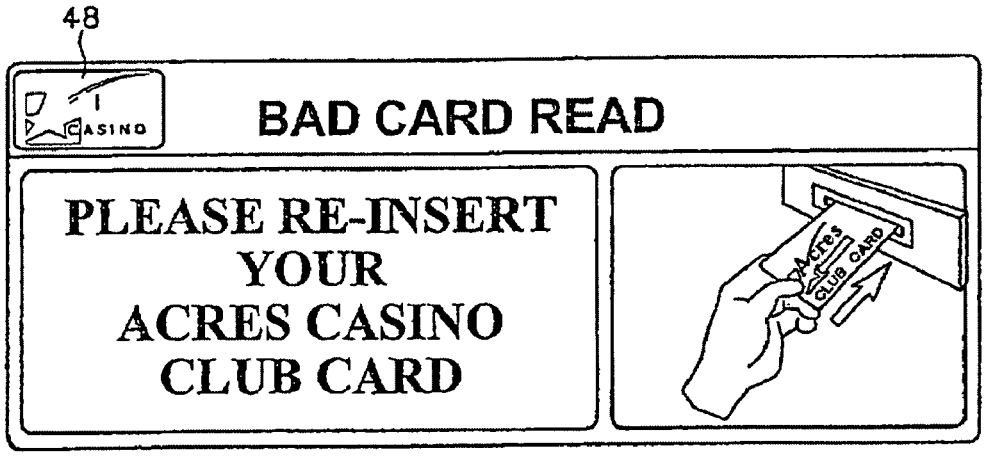

If, however, a player's card format cannot be recognized when it is inserted into slot 20, the display of FIG. 12 appears.

Figure 13:
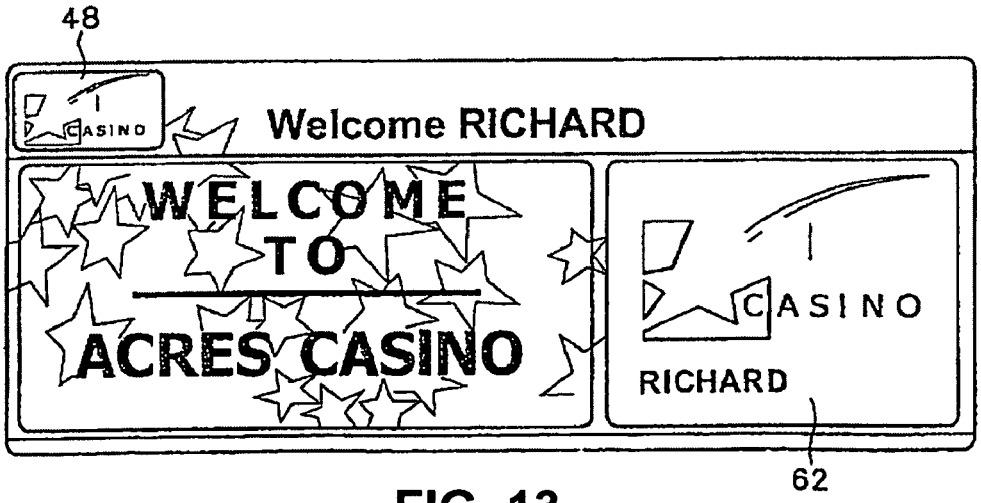

When the format is recognized and the PIN is transmitted to board 31, the card information and PIN stored on a network computer is compared with those entered at slot machine 10. If there is a match, the image of FIG. 13 is displayed. The FIG. 13 image includes a personalized welcome, using the name associated with the player account, and a replica of the player card 62. Speakers 42, 44, also play accompanying audio. The system operator can control the colors on the image of FIG. 13 via the Content Manager. The screen will persist on the display for up to 30 seconds, a time that can also be configured by the operator on the Content Manager.

In addition, the system is configured to require the PIN as described above each time the player is either requesting personal information, such as cash or point balances, or issuing commands to effect account changes, such as transferring cash to or from a slot machine. This provides increased account security, including protecting the player's account in the event that he or she leaves the game without withdrawing the card.

Figure 15:
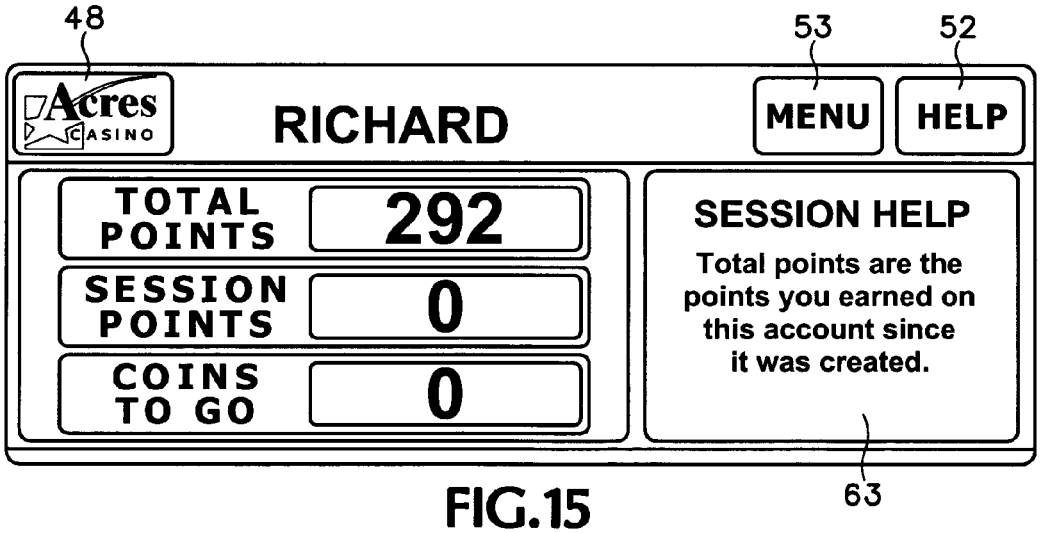

After the welcome screen of FIG. 13, a session screen, shown in FIG. 14 is displayed. A Menu button 53 calls the image of FIG. 18 as later discussed in more detail. The session image includes the player's name at the top and displays and updates the player's total player tracking points (Total Points), points accrued during the current session (Session Points), and additional coins to play necessary to generate additional points (Coins to Go). The Coins to Go display can be enabled or not depending upon the operator's preference, using the Content Manager. The image of FIG. 14 persists until the player takes some action or the system interrupts the session screen with a higher priority display. FIG. 15 depicts another image of the FIG. 14 session screen after Help button 52 is touched. This displays a stored help screen relating to—in this case—the session screen. The help displayed is in the context of the current screen upon which Help button 52 is touched, i.e., the help relates to the display on the current screen.

Figure 16:
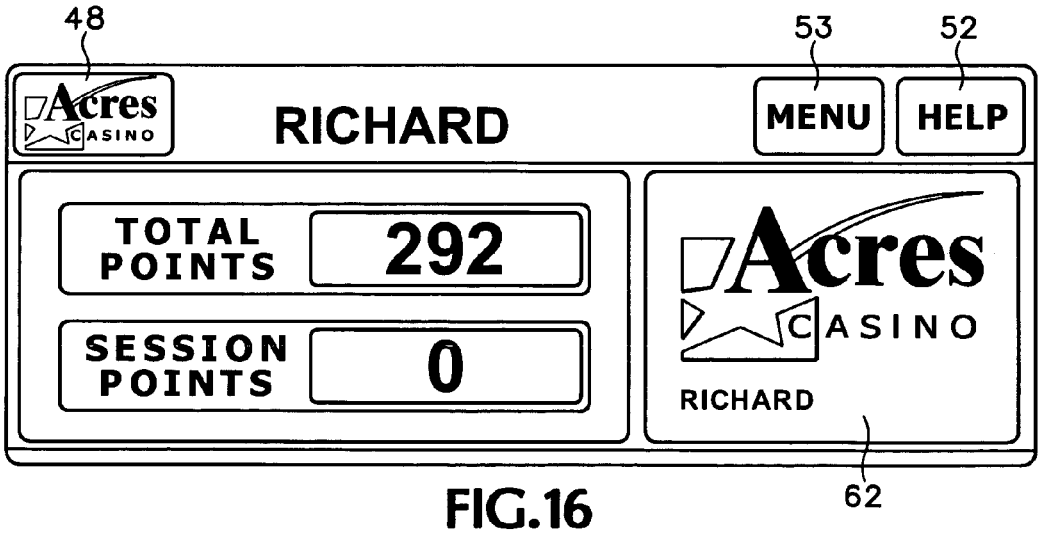

FIG. 16 is another version of the FIG. 14 session screen. The FIG. 16 image does not include the Coins to Go field as a result of a configuration command entered by the casino operator on the Content Manager.

Figure 17:
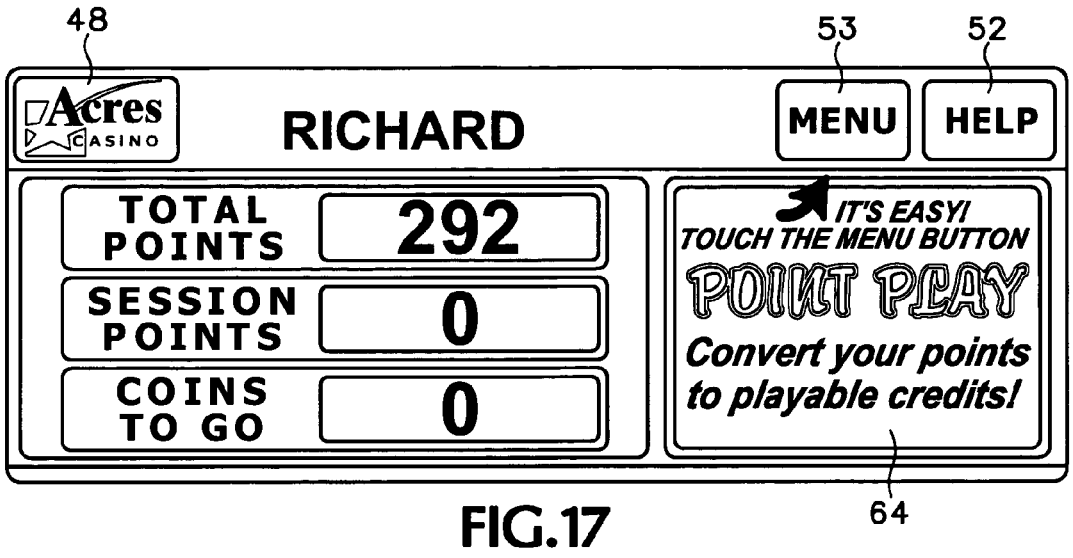

FIG. 17 is still another implementation of the session screen of FIGS. 14 and 16, which includes a session-attract area 64. When the session-attract feature is implemented, area 64 is configurable to display up to 32 screens in any sequence. When the sequence ends, it repeats in round-robin fashion. Each displayable screen has a programmable duration, time of day control, and sound controls, all of which are programmable by the operator using the Content Manager. The session-attract area may also be used to notify players of special events and awards.

Figure 18:
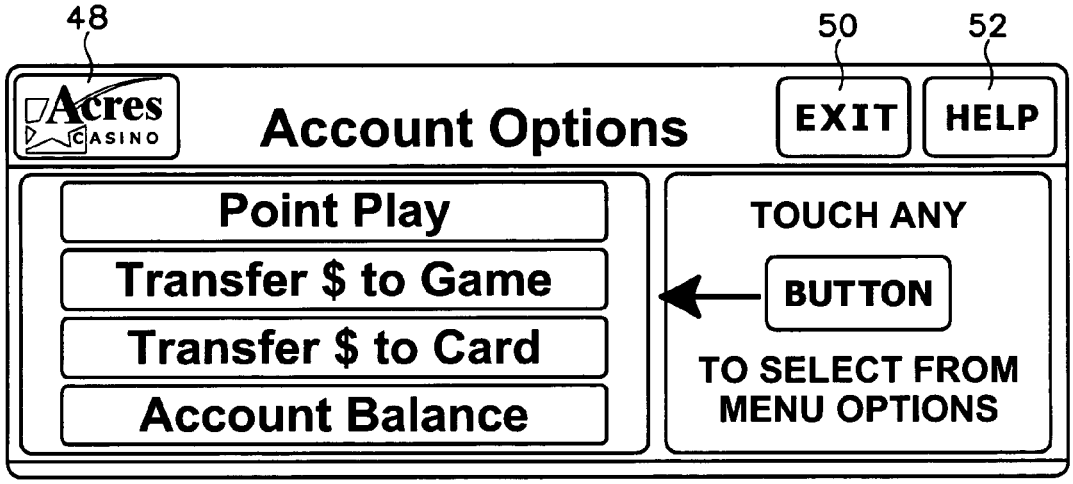

FIG. 18 depicts a menu-mode screen, which is initiated when the player touches Menu button 53. Menu screens contain two touch screen buttons in the upper right-hand corner, namely Exit button 50 and Help button 52. As previously mentioned, the Exit button allows the player to cancel current operations or move back to the previous screen. Any of the four buttons on the left are pushed to select different menu options.

Figure 19:
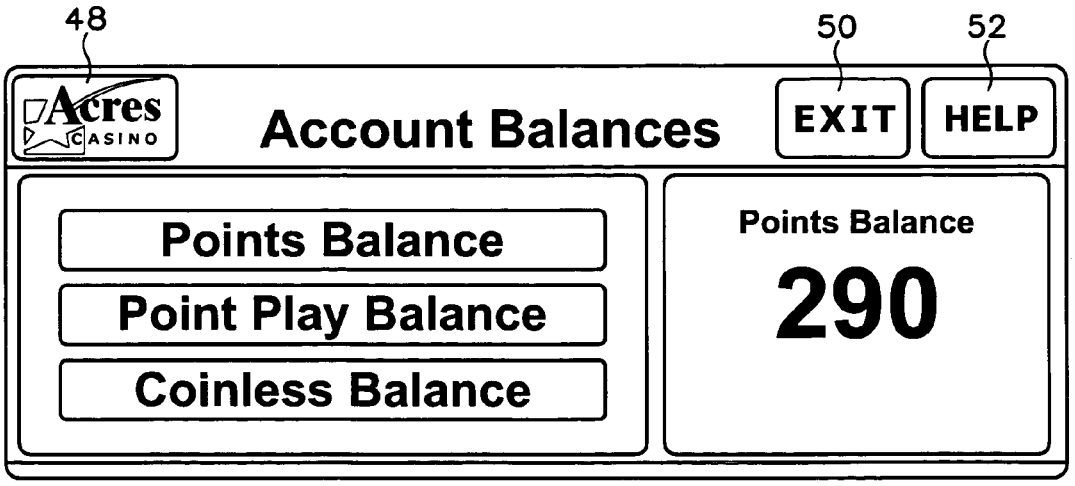

For example, touching the Account Balance button in FIG. 18 produces the menu display screen of FIG. 19. Pushing each of the buttons on the left of FIG. 19 provides the corresponding balance on the right of the screen. The Points Balance button provides the balance of player tracking points. Touching the Point Play Balance button shows the value of machine credits that have been converted by the player at the gaming machine from player tracking points. These credits are referred to by applicant as Xtra Credit points and are described in applicant's co-pending '065 application.

The Coinless Balance button in FIG. 19 provides a balance for a player's cashless play account as described in applicant's co-pending '598 application.

Figure 20:
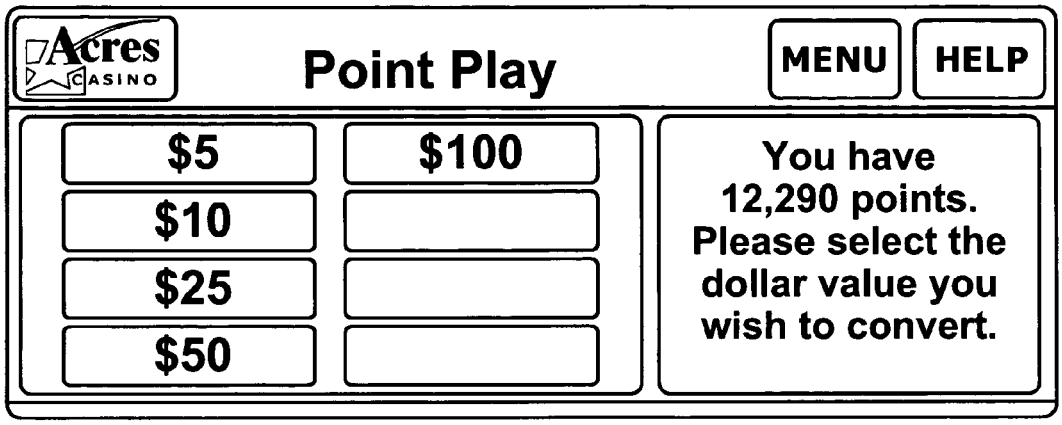
Figure 21:
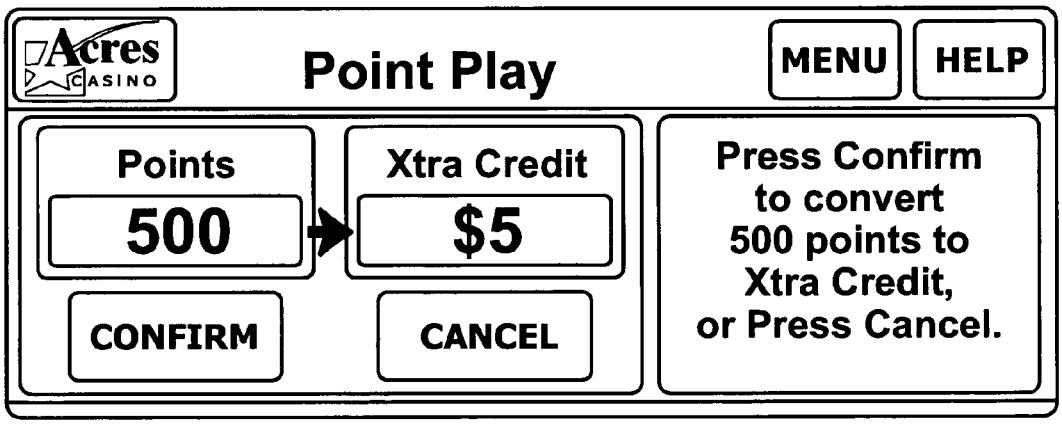

Returning again to FIG. 18, when Point Play button is touched, the image of FIG. 20 appears on the screen. This is the feature that allows players to convert their point balances into game playable credits (Xtra Credit). On the image of FIG. 20, the player selects one of the dollar amounts of credits that he or she wishes to exchange for points in the player's account. Touching, e.g., the $5 button in FIG. 20 produces the Point Play image of FIG. 21. Touching the Confirm button in FIG. 21 moves $5.00 of Xtra Credit to the player's Xtra Credit account, designated "Point Play Balance" in FIG. 19.

Figure 22:
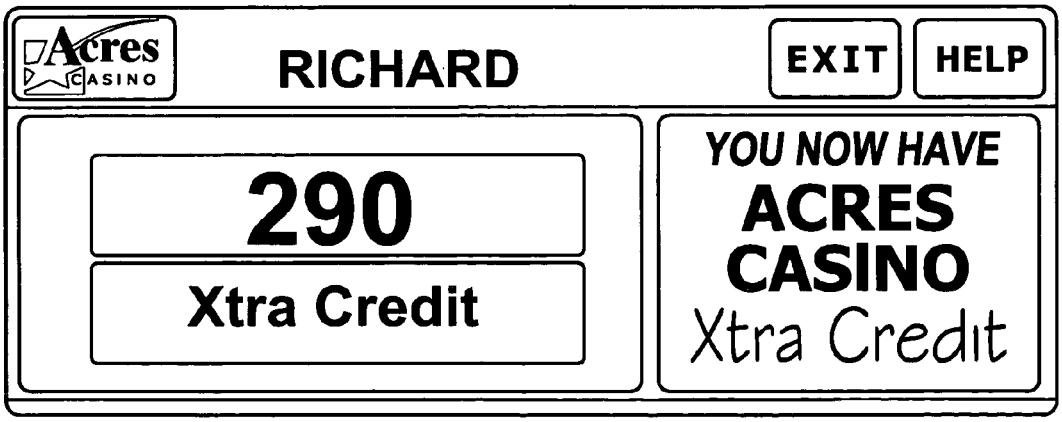

Turning now to FIG. 22, an Xtra Credit display replaces the Welcome display of FIG. 13 when a player has Xtra Credit. The player then plays off any Xtra Credit, and—after doing so—the session screen, like, e.g., the session screen of FIG. 14, is displayed.

Figure 23:
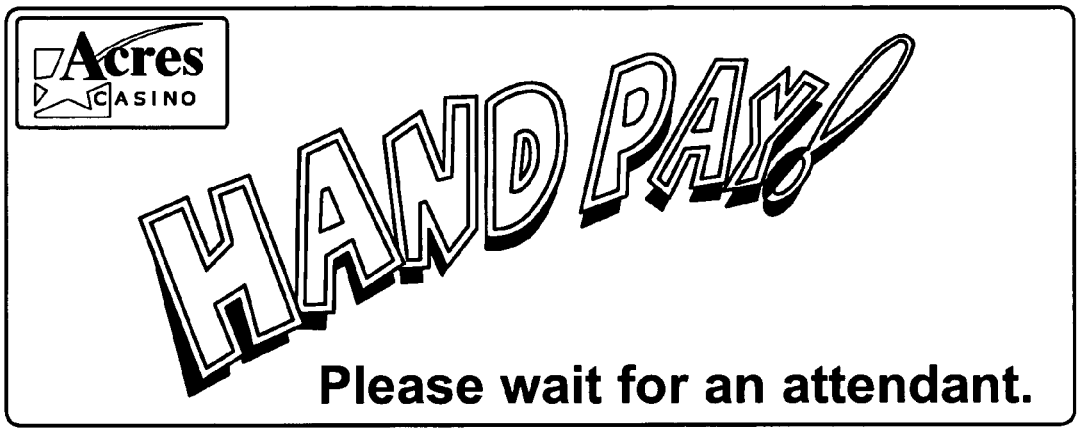

FIG. 23 illustrates a Hand Pay display, which appears whenever the slot machine is in a hand pay condition. This typically occurs for large jackpots or bonus awards that are too large to apply to the machine's credit meter. This display persists until the hand pay condition is cleared from the slot machine, typically by an attendant who arrives to clear the machine in a known manner.

Figure 24:
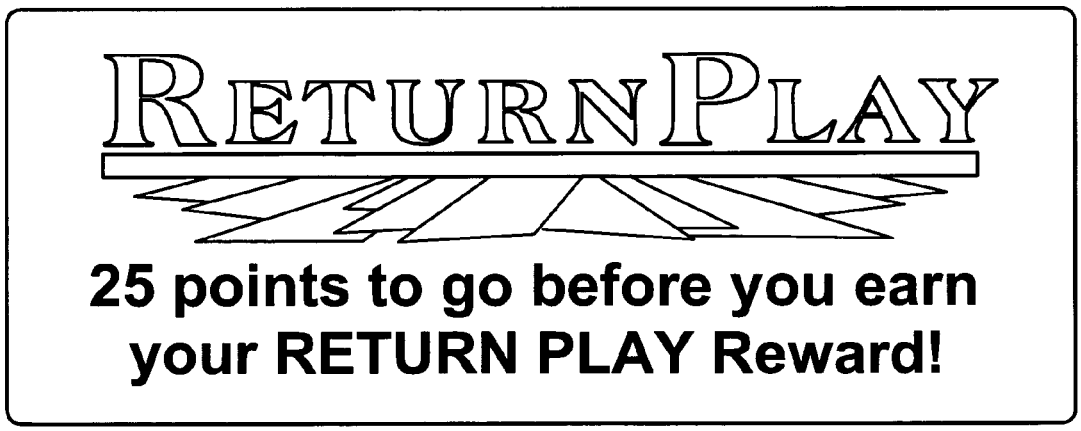

FIG. 24 depicts a Return Play screen which is associated with the return play bonus, described in the '961 patent. Briefly, upon earning a pre-determined number of points in a session, the player is awarded gaming credits that cannot be played until after a pre-determined later time. This induces the player to return to the casino to play off his or her credits.

Figure 25:
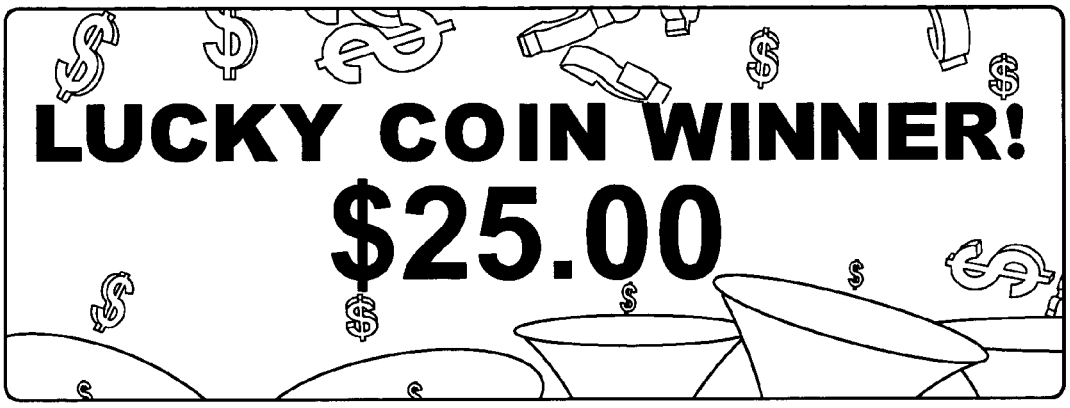

FIG. 25 depicts a screen that appears when the player is a winner of the Lucky Coin bonus, a random award that is described in applicant's U.S. Pat. No. 6,375,569, issued Apr. 23, 2002.

Figure 26:
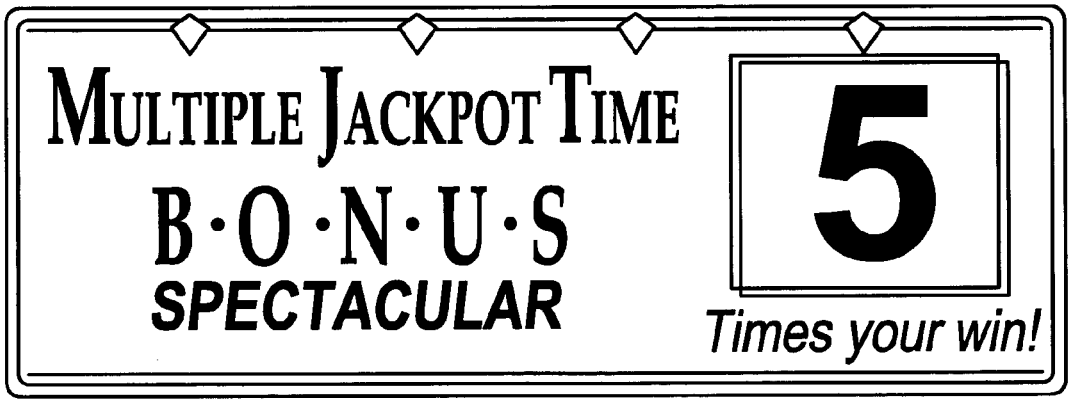

FIG. 26 informs the player that the multiple jackpot bonus is in effect, a bonus promotion described in the '961 patent.

Figure 27:
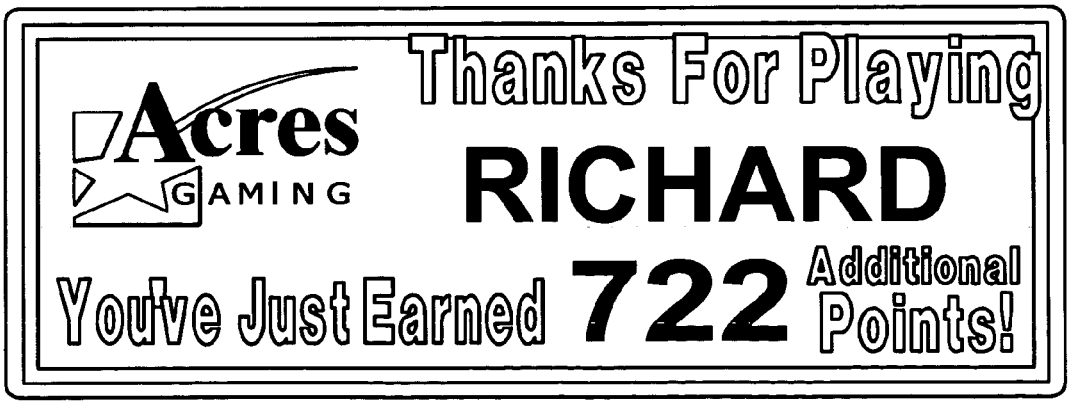

Upon withdrawal of the player's card, the image of FIG. 27 is displayed. The image persists on the screen for a period of up to 10 seconds, which can be designated by the operator on the Content Manager.

In another aspect of the present invention, the display can be used to implement what are sometimes referred to as secondary or top-box games. For example, U.S. Patent Application Ser. No. 60/282,703 and U.S. patent application Ser. No. 10/120,196 disclose a secondary game that includes a display mounted on the top of a commercially available slot machine. The same secondary game can be implemented via software stored on board 39. This software can drive display 16 in the same fashion as the upper portion of the game described in the '703 application. A percentage of each coin played in a session can be allocated to a pool. This pool can fund an award resulting in playing the secondary game implemented on display 16.

In addition, a subset of slot machines on the casino network can be grouped to provide a secondary game in which multiple players participated as shown in U.S. patent application Ser. No. 09/104,145, which is assigned to the assignee of the present application and which is incorporated herein by reference for all purposes. Software implementing that game can be used to cause the display 16 on each of the grouped machines to depict substantially the same graphics associated with the secondary game screen as shown in the '145 application.

Finally, a subset of the slot machines or the entire network could be selected for periodic bonus games that utilize display 16.

Thus, although particular embodiments for communicating with a player using a mountable interactive interface have been discussed, it is not intended that such specific references be considered as limitations upon the scope of this invention, but rather the scope is determined by the following claims and their equivalents.

We claim:

1. A mounting structure system associated with a plurality of networked gaming devices comprising:

a plurality of player tracker receivers rotatively, pivotally and slidably coupled to a post-like mounting structure to be supported by the mounting structure such that the player tracker receivers are rotatable about the mounting structure, are pivotable upwardly and downwardly with respect to the mounting structure and are slidable with respect to the mounting structure, wherein the mounting structure is configured and arranged to be retrofitted in the area of the plurality of networked gaming devices and located near or away from the plurality of networked gaming devices; and a first display constructed and arranged to be mounted on one of the plurality of player tracker receivers and a second display constructed and arranged to be mounted on a second one of the plurality player tracker receivers wherein the first display is associated with a first one of the plurality of networked gaming devices and the second display is associated with a second one of the plurality of networked gaming devices.

2. The system of claim 1 wherein a display is a touch screen display.

3. The system of claim 2 wherein the touch screen display is configured to communicate services to a player.

4. The system of claim 2 wherein the touch screen display is configured to receive commands from a player and each interface including a display associated with one of the gaming devices.

5. A device for communicating with players of gaming devices on a network of gaming devices comprising:

a post-like mounting structure configured and arranged to be retrofitted in the area of the gaming devices and located near or away from the gaming devices, and a plurality of player tracker interfaces rotatively, pivotally and slidably couplable to the mounting structure such that the player tracker interfaces are rotatable about the mounting structure, are pivotable upwardly or downwardly with respect to the mounting structure and are slidable with respect to the mounting structure, each player tracker interface being operatively connected to one of the gaming devices when in an operative condition and each player tracker interface including a display associated with one of the gaming devices;

the gaming devices being operatively connected to a computer, the computer generating information about services provided to one or more of the players via a display; and a circuit associated with each of the plurality of player tracker interfaces for creating images on a display associated with an interface responsive to such information.

6. The device of claim 5 further comprising a touch screen associated with each interface for accepting communications from the one or more players.

7. The device of claim 5 wherein the plurality of interfaces are removeably coupable to the mounting structure.

8. The device of claim 5 wherein the plurality of interfaces are interchangeably coupable to the mounting structure.

9. A system for communicating with a player of a gaming device on a network of gaming devices, the system comprising:

a host computer;

a network interconnecting gaming devices to the host computer;

a post-like mounting structure having a plurality of player tracker receivers rotatively, pivotally and slidably connected thereto such that the player tracker receivers are rotatable about the mounting structure, are pivotable with respect to the mounting structure and are slidable with respect to the mounting structure, wherein the mounting structure is configured and arranged to be retrofitted in the area of the gaming devices and positioned near or away from the gaming devices;

a first interface coupled to one of the plurality of player tracker receivers and a second interface coupled to another one of the plurality of player tracker receivers, the interfaces constructed and arranged to communicate services to the player; and a display associated with each interface for generating images relating to the services.

10. The system of claim 9 wherein an interface couplable to one of the plurality of receivers comprises an interface removably coupable one of the plurality of receivers.

* * * * *

UNITED STATES PATENT AND TRADEMARK OFFICE

CERTIFICATE OF CORRECTION

PATENT NO. : 7,611,408 B2
APPLICATION NO. : 10/888562
DATED : November 3, 2009
INVENTOR(S) : Martin et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1151 days.

Signed and Sealed this

Twelfth Day of October, 2010

David J. Kappos

David J. Kappos
*Director of the United States Patent and Trademark Office*